US005540595A

United States Patent [19]

Bernitz et al.

[11] Patent Number: 5,540,595

[45] Date of Patent: Jul. 30, 1996

[54] LAMP OPERATING ACCESSORY CIRCUIT CONSTRUCTION

[75] Inventors: Franz Bernitz, Unterhaching; Peter Niedermeier, Munich; Josef Osterried, Ottobrunn, all of Germany

[73] Assignee: Patent-Treuhand-Gesellschaft F. Elektrische Gluehlampen mbH, Munich, Germany

[21] Appl. No.: 288,553

[22] Filed: Aug. 10, 1994

[30] Foreign Application Priority Data

Sep. 23, 1993 [DE] Germany ..... 9314422 U

[51] Int. Cl.[6] ..... H01R 13/58

[52] U.S. Cl. ..... 439/76.1; 439/449; 439/470

[58] Field of Search ..... 439/76.1, 449, 439/456, 459, 460, 470, 638, 473, 76.2

[56] References Cited

U.S. PATENT DOCUMENTS 4,023,879 5/1977 Braund et al. ..... 439/76.1

FOREIGN PATENT DOCUMENTS 0240736 10/1987 European Pat. Off. .
318863 6/1989 European Pat. Off. ..... 439/76.1
2154763 5/1973 France .
2679008 1/1993 France .
2638669 4/1977 Germany .

*Primary Examiner*—Gary F. Paumen
*Attorney, Agent, or Firm*—Frishauf, Holtz, Goodman, Langer & Chick, P.C.

[57] ABSTRACT

To permit, selectively and in accordance with safety or standardization requirements, connection of different electrical supply devices, such as extending cables or terminal posts, pins or clamps, to a single, standardized operating or accessory circuit retained on a circuit board (2) within a housing (1), the housing is formed with a connection receiving portion (5*a*) selectively differently constructed connection parts (3, 3') forming insert elements are provided, dimensioned and shaped to fit into the receiving portion of the housing. The connection parts, forming the insert element, thus can be constructed according to the respective safety or standardization requirements without otherwise affecting the structure of the substantially more expensive operating or accessory circuit in the housing. A strain relief can be integrated with the construction, for example secured to the housing and/or the connection part to clamp wires or cables projecting from the housing, attached to terminal pins, posts or clamps of one form of connection part, or directly from another form of connection part.

7 Claims, 9 Drawing Sheets

LAMP OPERATING ACCESSORY CIRCUIT CONSTRUCTION

FIELD OF THE INVENTION

The present invention relates to the construction of an accessory or operating circuit for lamps, and more particularly to the structure of a housing for such accessory circuits which is suitable for selective connection by supplied cables or to have connection terminals for externally applied cables.

BACKGROUND

Many lamps, and particularly discharge lamps such as fluorescent lamps, low-voltage lamps such as halogen incandescent lamps designed for operation of voltages below network voltages use accessory operating or accessory circuits. They include circuit elements designed to convert electrical power derived from a standard outlet plug, for example 110/220 V, 60/50 Hz, to the required voltage and frequency characteristics of electrical energy for optimum operation of the lamp for which the circuit is designed. This circuit, usually retained on a circuit board, has to be placed in a housing, provided with connections for energy supply from a network as well as connections for the lamp itself. The housing can be external of the lamp and, for example, be a component of a light fixture or luminaire, to supply one or more electric lamps with electrical energy at the required voltage, current and frequency characteristics.

The operating circuit for electric lamps is frequently retained within a housing having a unitary connection portion. Safety and standardization requirements in different jurisdictions vary and, respectively, may mandate integrated cable or wire connections from the accessory housing, or terminals for subsequent connection to externally supplied cables. Consequently, the connecting portion of the operating circuit may have either terminal clamps, such as terminal screws, snap-in or other terminal connectors, or may merely form a feed-through or lead-through arrangement for cables passing directly into the interior of the housing. Different arrangements of the housing, thus, were required, depending on whether cables or terminals were mandated by the user, or by safety and standardization requirements.

THE INVENTION

It is an object to provide an accessory or operating circuit construction for electrical lamps in which the electrical connection can be, selectively, in form of either terminals, such as screw, spring or other clamp terminals, or as connecting cables, without requiring any change in the housing structure itself, so that one single operating circuit structure can be used regardless of the connection requirements.

Briefly, the housing for the accessory circuit, usually an electrical circuit arrangement mounted, for example, on a circuit board, is formed with a modular connection receiving portion; a terminal part, as an insert element, is provided, the connection part having differently configured electrical supply devices such as cables, terminal posts, screws, clamp posts, spring connectors or the like, to receive energy from an external network source, and to provide energy to at least one lamp. The connection parts are constructed as selectively useable insert; elements which are dimensioned and shaped to fit into the connection portion of the housing.

The arrangement, in which the electrical supply elements from a network and to the lamp are retained on a separate insert element, but designed to fit into the receiving portion of the housing, permits construction of a single housing regardless of safety or standardization requirements, with only the simple and easily replaceable connection part being specifically made to fit specific safety or standardization requirements. Preferably, the connection part forming the insert element is secured to the housing by matching guide and retention structures, such as grooves and projecting tongues fitting into the grooves, respectively secured to the connection portion and to the housing. This, then, readily permits use of the desired connection part without any change in the housing construction and the circuit elements retained therein.

In accordance with a preferred feature of the invention, a strain relief arrangement is coupled to the terminal part so that any cables which lead to the connection part are protected, and the connection part, or cable connections within the housing or the connection part are protected against damage due to mechanical stresses. Such stress relief or strain relief, preferably, is so constructed that it also covers electrical terminals of the connection part, to provide a safety cover. The strain relief is preferably releasably located on the housing, for example by a screw connection; if space within a light fixture or luminaire is at a premium, and the terminals are electrically and mechanically protected by the construction of the luminaire anyway, the strain relief can be omitted or removed, resulting in lower overall size.

In accordance with a preferred feature of the invention, the housing is essentially block or box-shaped with a cover cap of plastic material and a metallic base plate. The metallic base plate, at the same time, forms a heat sink for electrical components located within the interior of the housing. One of the facing end walls of the housing is constructed in form of a connection portion, preferably with guide elements for the connection part. Suitable guide elements are two parallel guide rails or depressions into which projecting wings from the connection part can fit. These guide depressions or grooves can, preferably, also be used to hold the strain relief on the housing.

DRAWINGS

DETAILED DESCRIPTION

Figure 1:
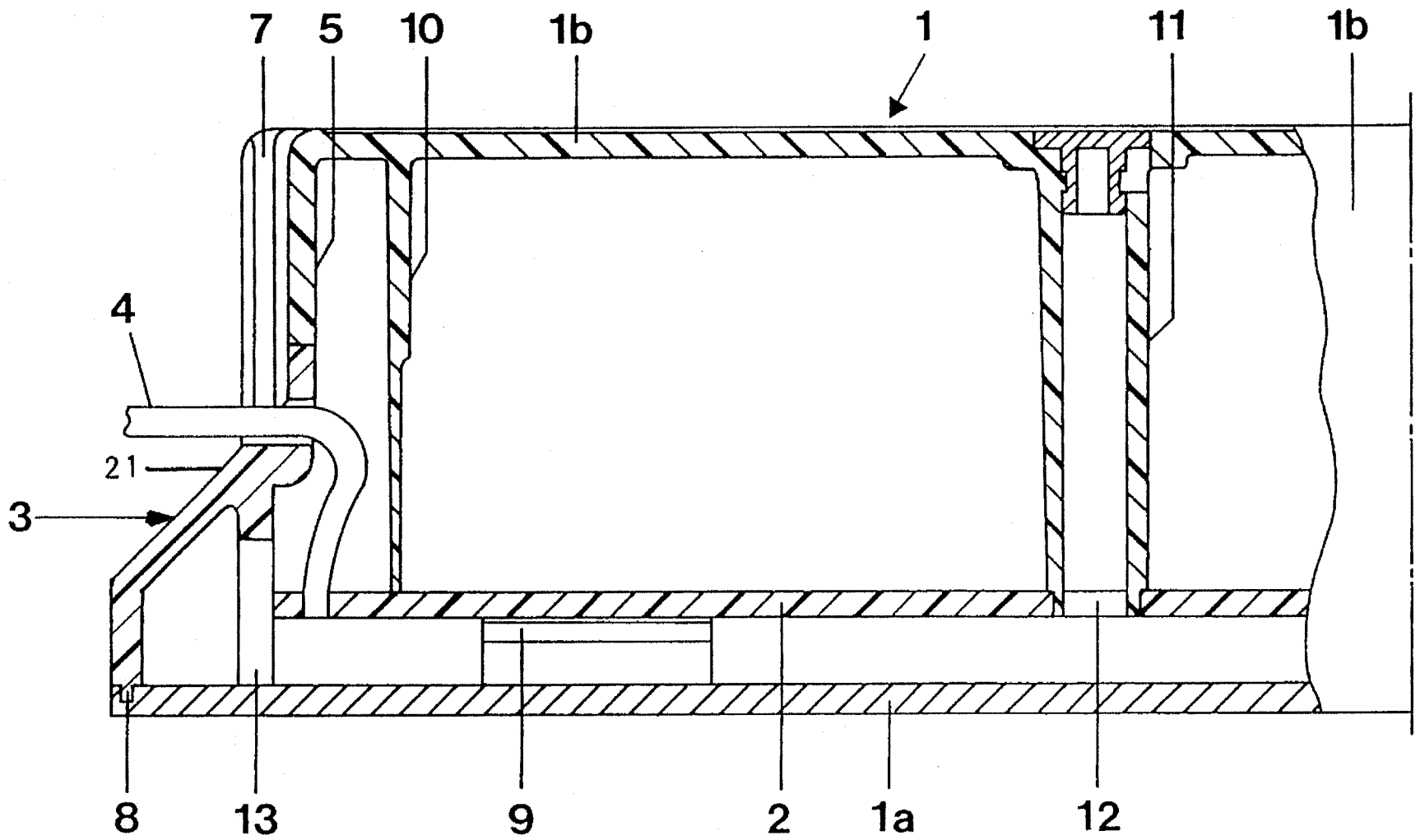
FIG. 1 is a highly schematic side view, partly in section, of the operating or accessory circuit construction, and sectioned along section line I—I of FIG. 2.

FIG. 1 illustrates the general structure, partly in section, in connection with a construction having integrally connected cables.

The operating or accessory element is intended to supply electrical lamps with electric energy, derived from an external energy source, not shown. The accessory circuit construction has an essentially box or block-shaped housing 1, the interior of which retains a circuit board or circuit plate 2, on which an electrical circuit and circuit components (not shown) are secured, as well known. The housing 1 is formed of an aluminum plate 1*a*, which forms the base of the housing of the construction, and of an essentially block-shaped plastic cap 1*b*. The circuit board 2 is spaced from the bottom plate 1*a* by a small distance, for example about ½ cm, as well known, for example by spacer sleeves and screws, shown only schematically at 2*a*.

In accordance with the present invention, a module connection part 3 is provided, forming an insert element for association with the housing 1. Five connecting cables 4 extend from the connection part 3 to receive electrical energy from an outside source and to supply suitably converted electrical energy to one or more electrical lamps. The connection part 3, formed as an insert element, is received in an essentially rectangular recess or opening within the end wall 5 of the plastic cap 1*b*, dimensioned and shaped to fit into this receiving portion. The receiving portion or recess or opening within the wall 5 is formed, as shown in FIG. 1, by an inwardly depressed trough-like recessed connection portion 5*a* in the end wall 5, delimited at the bottom by the bottom plate 1*a*. Two parallel vertically extending guide grooves 7 delimit the connection portion 5*a* at the lateral sides, extending over the entire height of the end wall 5. This connection portion may receive the cables 4, or terminal elements 4' (FIG. 3), as will appear below.

Figure 2:
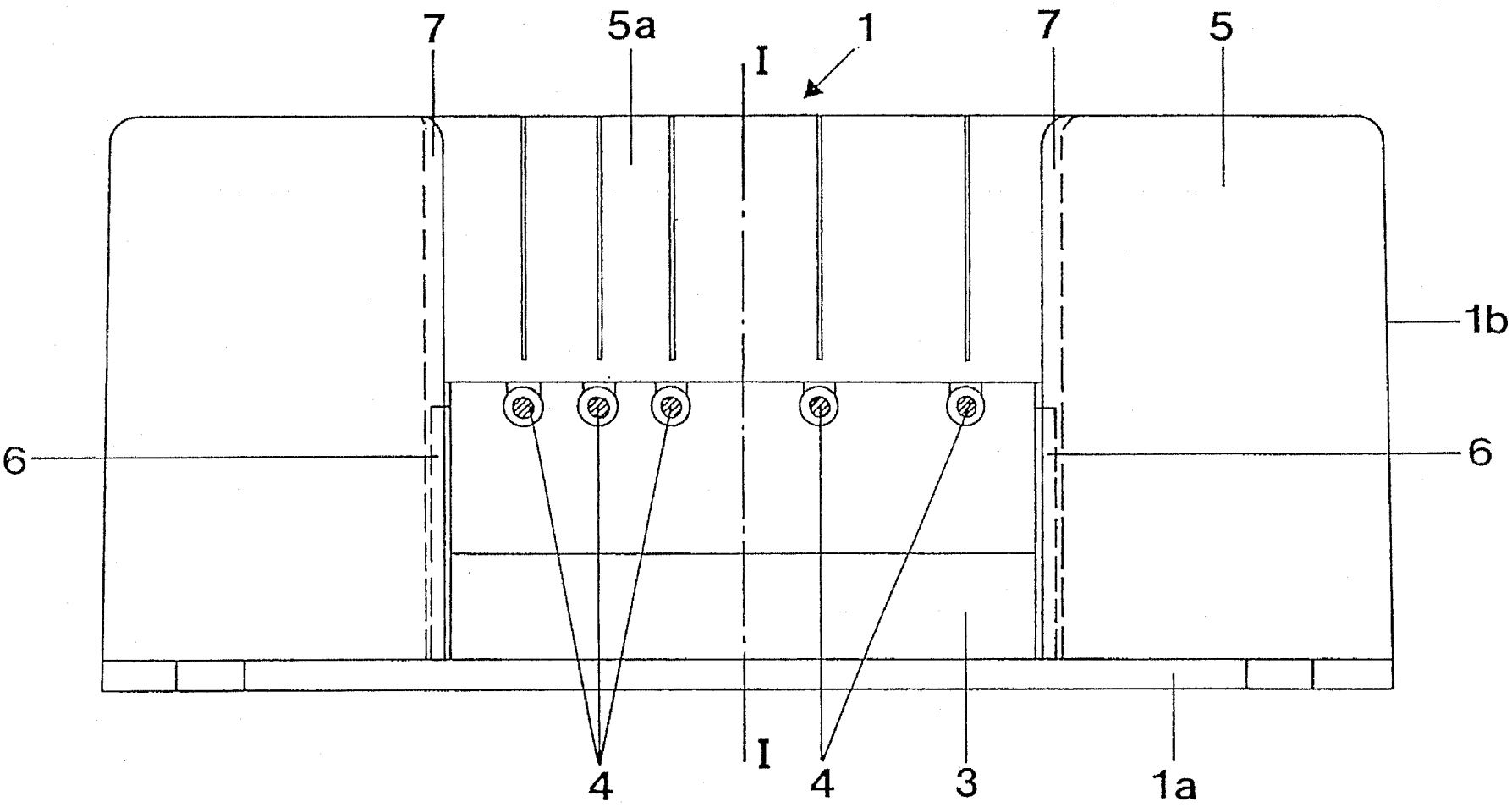
FIG. 2 is a front view of the construction of FIG. 1, and illustrating use of the structure with cables forming electrical connections.

The terminal part 3 has two laterally formed unitary wings or strips or ribs 6, shown in FIG. 2 only in broken-line representation since they are not visible after the terminal part is fitted on the receiving portion, the ribs 6 being received in the grooves 7 of the plastic cap 1*b*. The connection part 3 is retained and secured in the bottom plate 1*a* by projecting ribs 8, fitted in suitable recesses in the bottom plate 1*a* or by other suitable interconnecting or interengaging arrangements, such as a groove and rib connection or the like. The connecting cables 4 are connected to electrical terminals on the circuit board 2. The plastic cap 1*b* has internally projecting ribs to form a snap-over connection 9 with the circuit board 2, snapping beneath the circuit board 2, when assembled.

An additional separating wall 10 is provided, located just behind the front wall 5 of the housing 1, and extending from the upper side of the plastic cap 1*b* down to the circuit board 2. The housing 1, further, is formed with a unitary fill tube 11, to permit filling of a potting compound into the housing 1 of the operating or accessory circuit. Openings 13 formed in the rear portion of the terminal part 3 permit flow of the potting compound up to the connection of the cables 4 with the electrical terminals on the circuit board 2, thus providing encapsulated retention of the cables 4, and strain relief for the cables 4 within the housing itself. The potting compound also improves heat conduction from the electrical circuit components on the circuit board 2 to the metallic base plate la. After filling in the potting compound, the fill tube 11 is closed off by a plug 11*a*, and retained by a snap-in connection, as well known.

If standardization or safety requirements or other construction requirements of lamps or the like mandate externally accessible terminals, then it is merely necessary to replace the connection part 3 in which cables form the electrical connections by a differently designed connection part; the remainder of the housing stays the same.

Figure 3:
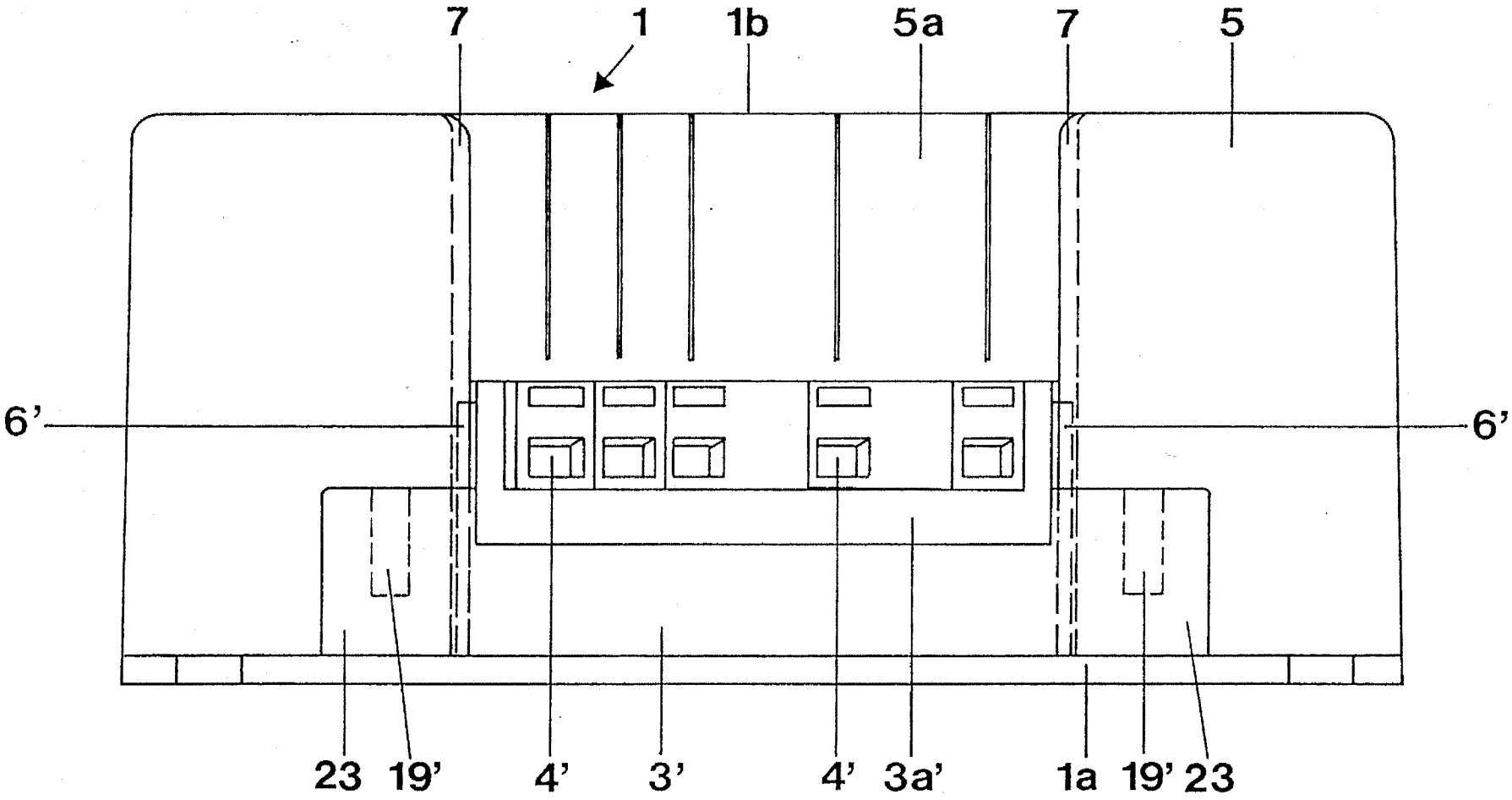
FIG. 3 is a front view similar to FIG. 2, and illustrating use of the structure with connecting terminals, to which externally supplied cables can be connected.
Figure 9:
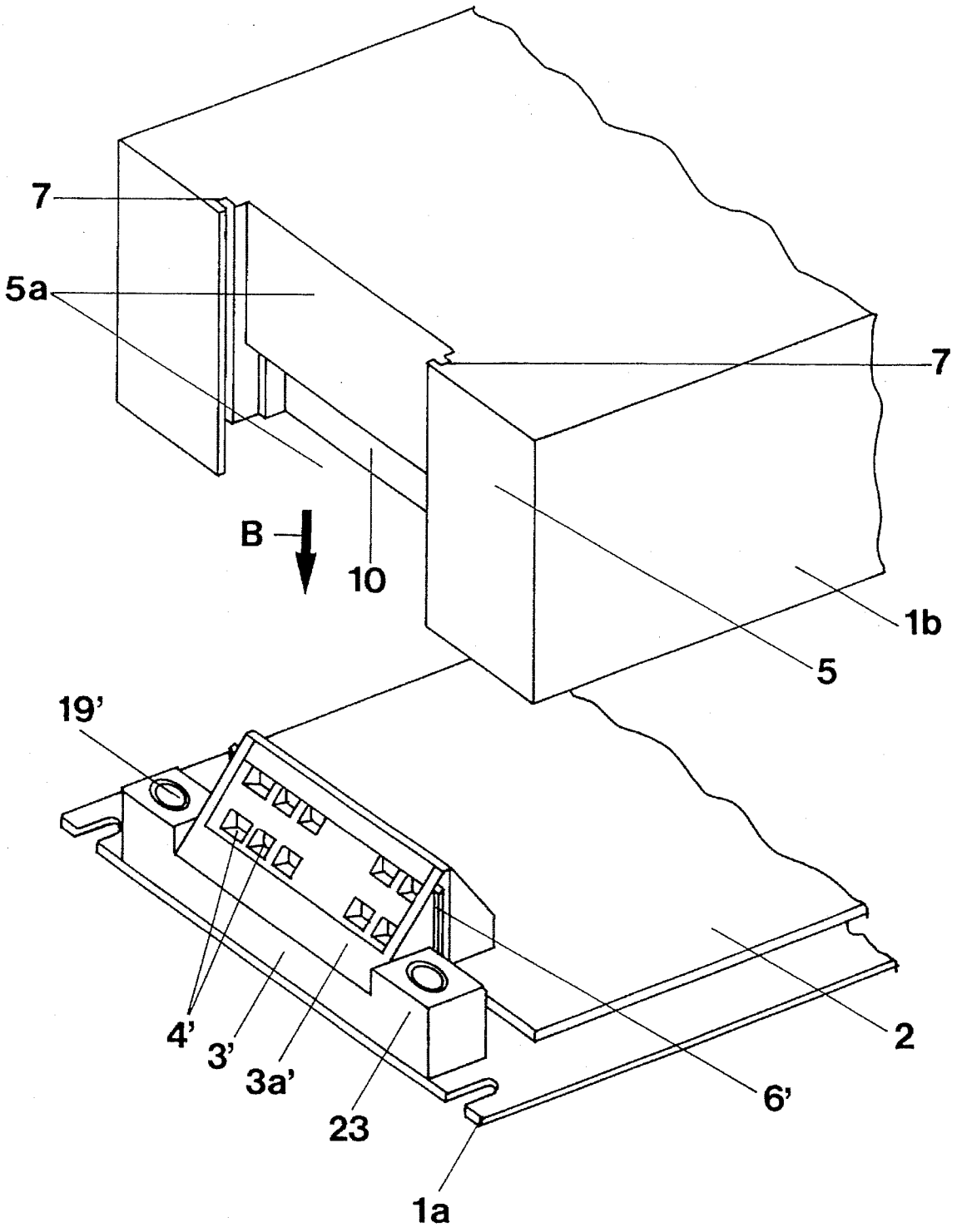
FIG. 9 is an exploded perspective view illustrating the connection between the accessory housing and the connection portion thereof.

The difference between the embodiments illustrated in FIGS. 1, 2 and 3 is merely in the construction of the connection part, shown in FIGS. 3 and 9 as part 3'. The view of FIG. 3 corresponds to that of FIG. 2. In all other details, the embodiments are identical. The upper portion of the forward wall of the connection part 3 or 3' is inclined, as shown at 21 (FIG. 1). The dimensions and shape of the connection part are identical. The electrical connections of the connection part 3', however differ from the cables 4 in that they are formed as terminal elements 4'. The terminal part 3' has, overall, five terminal elements 4', for example terminal posts, screws, spring clips, or the like, to receive electrical energy from an outside source,-which may include a grounding conductor, and to supply one or more electrical lamps. The terminal part 3' has two laterally projecting wings or ribs 6' engaging into the guide grooves 7 The guide elements 6', 7 are not directly visible in FIG. 3 and, therefore, are shown only in broken lines.

Figure 4:
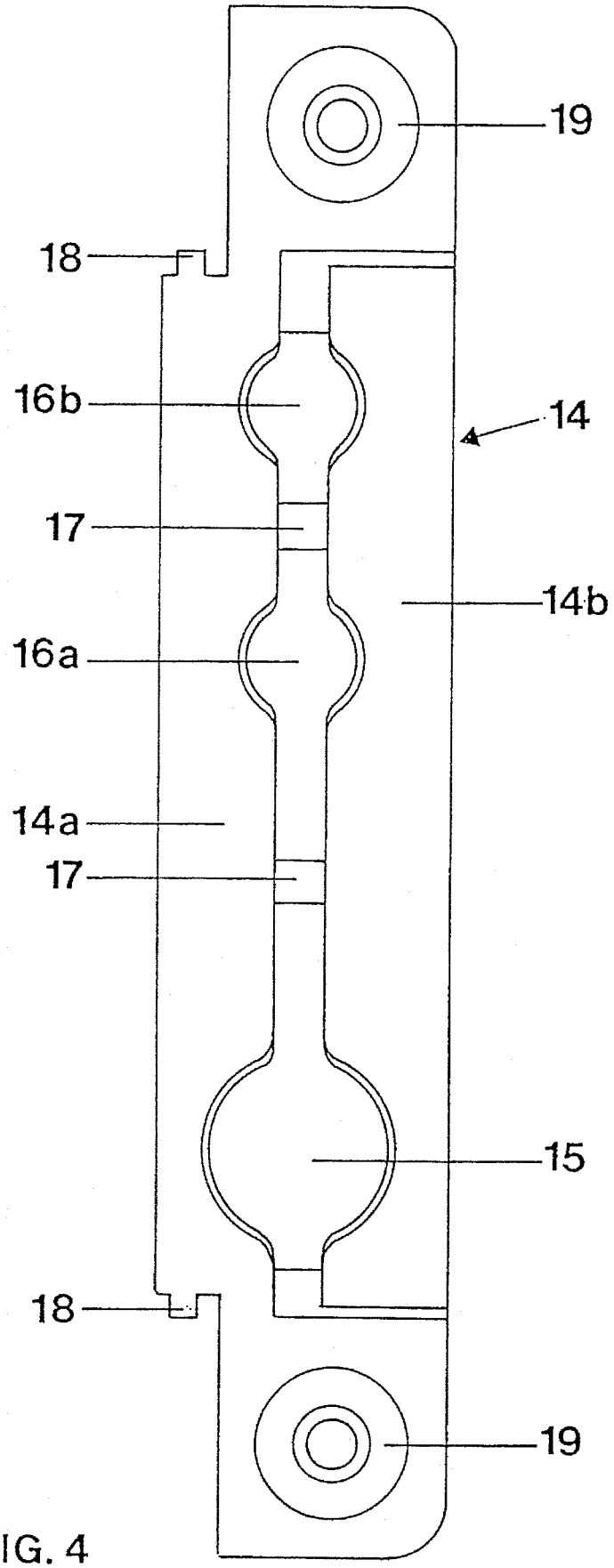
FIG. 4 is a top view of a strain relief for the structure of FIG. 1.
Figure 5:
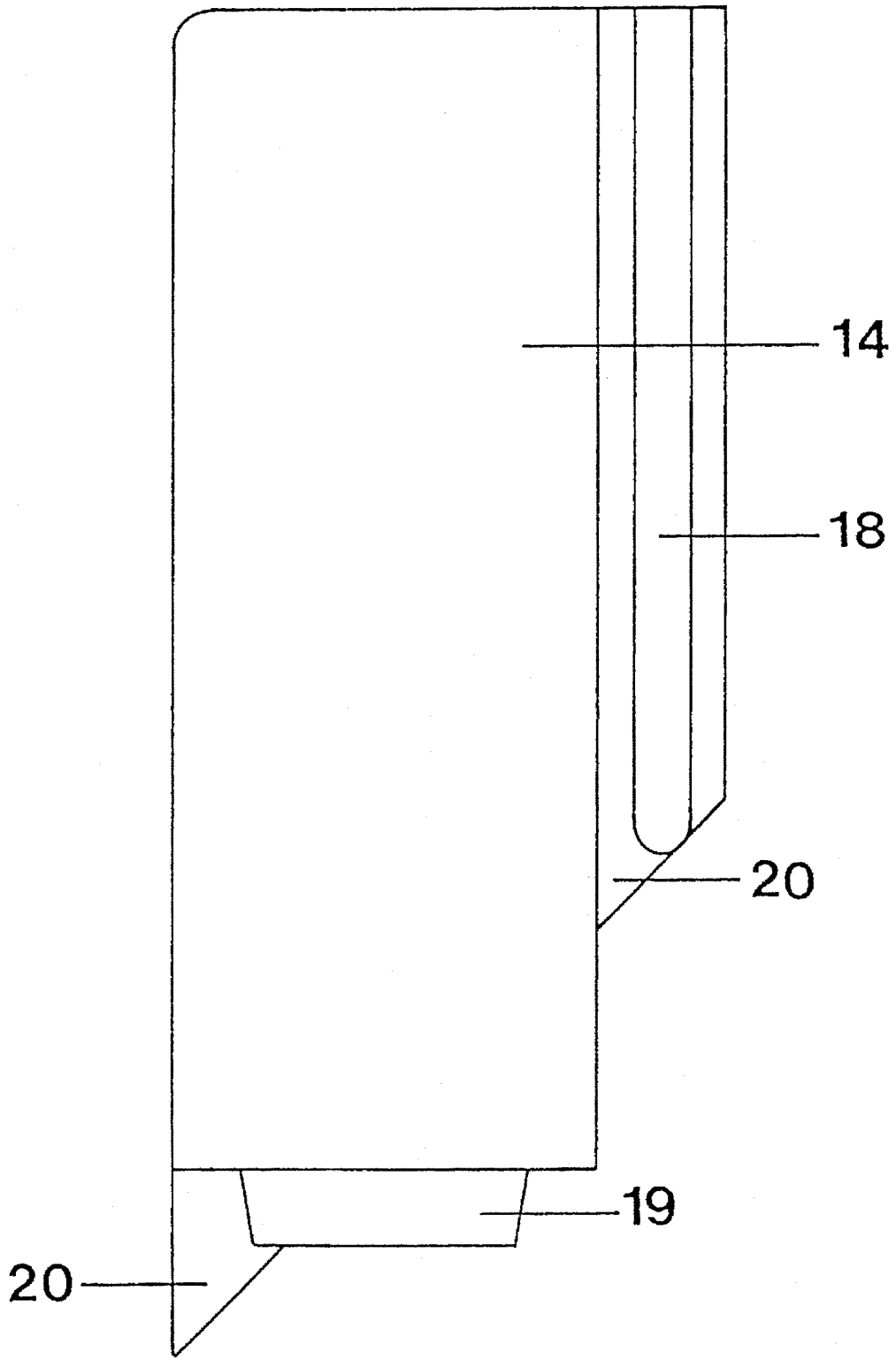
FIG. 5 is a side view of the strain relief of FIG. 4.

The operating construction also has a strain relief 14, see FIGS. 4 and 5, for externally connectable cables or supply connections to the respective terminals 4'. The strain relief is formed in two parts, and has a cover 14*a* and a cover top or cap 14*b* (FIG. 4). The two parts 14*a*, 14*b* define three through-openings 15, 16*a*, 16*b*, preferably all having elliptical cross section. The larger through-opening is used as a through-connection for a three-conductor network cable, for connection of the operating circuit with an external power supply, including a grounding conductor; the two smaller through-openings 16*a*, 16*b* are used to pass lamp connecting cables therethrough. Connecting screws 17 (FIG. 7), which connect the parts 14*a*, 14*b*, clamp the parts together and by more or less tightening of the screws 17, the size of the openings 15, 16*a*, 16*b* can be changed. Thus, externally supplied connecting cables can be passed to the terminals 4', and securely clamped between the cover 14*a* and the respective cover cap 14*b*. Such externally supplied cables are not shown in the drawings for simplicity of illustration.

Figure 6:
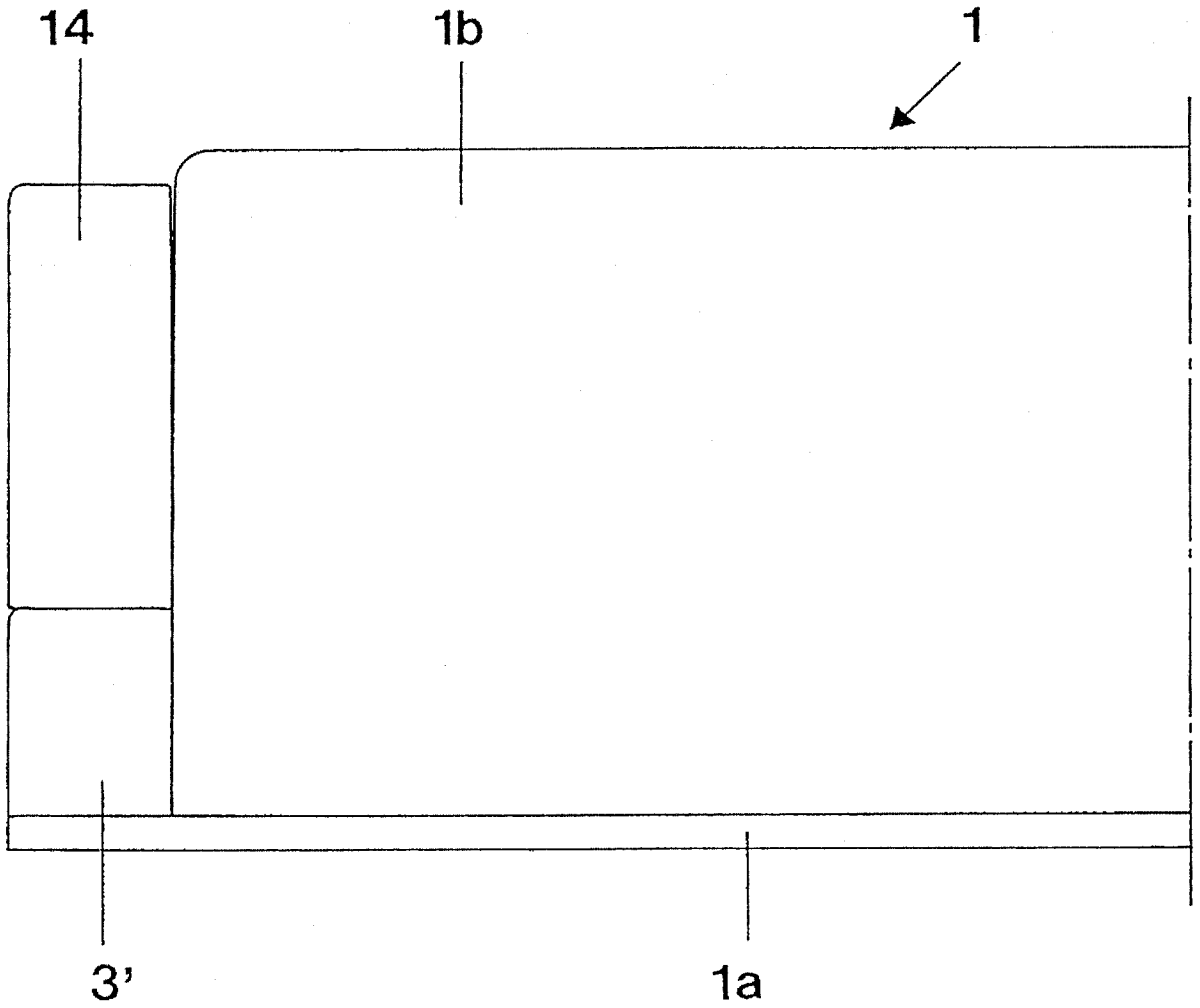
FIG. 6 is a side view of the structure with connecting terminals on the terminal part and the strain relief in place.
Figure 7:
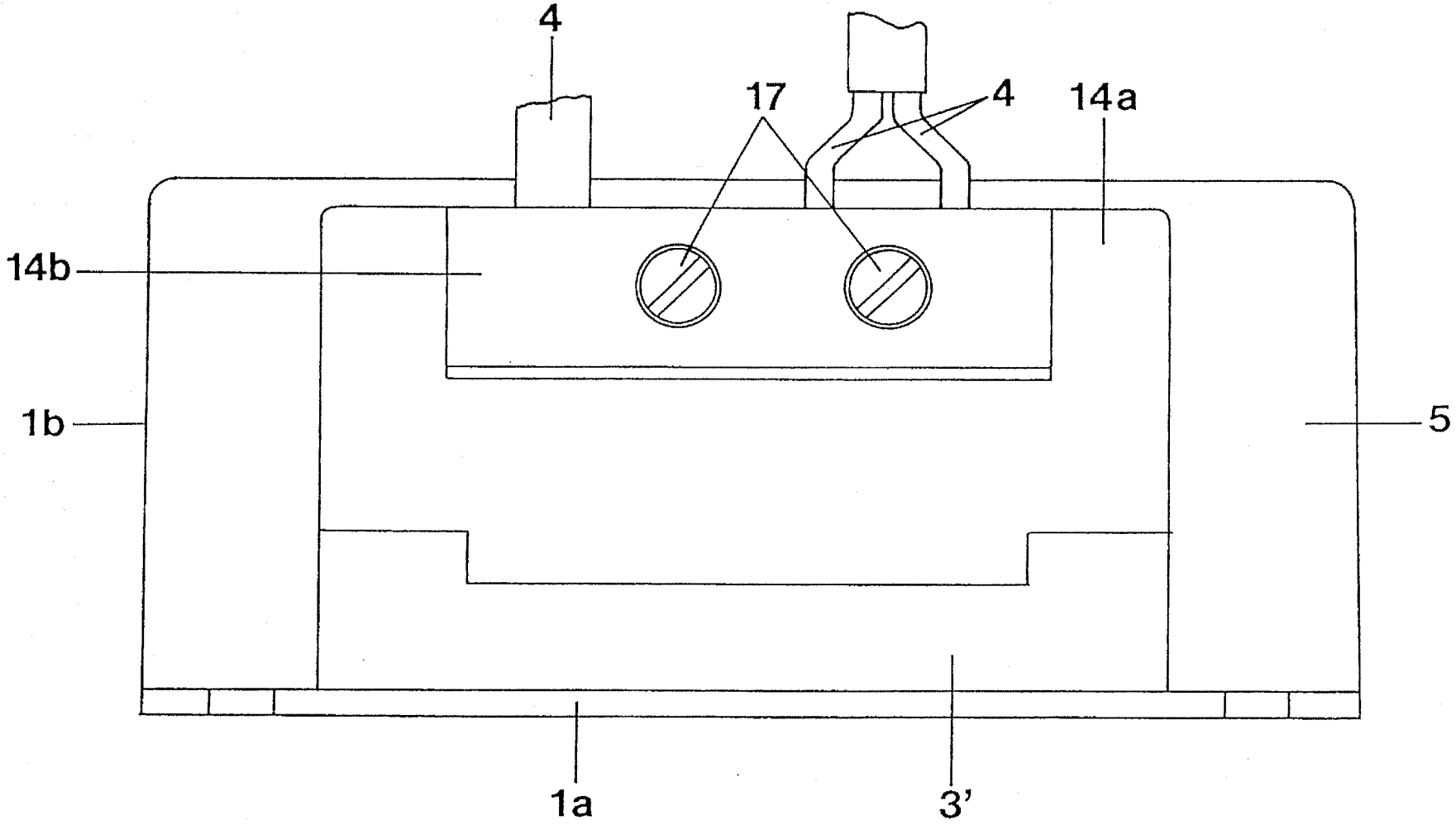
FIG. 7 is a front view of the structure of FIG. 6.

The cover 14*a* of the strain relief is dimensioned and shaped to fit into the recessed connection portion 5*a* of the front wall 5 of the cover cap 1*a*. It is formed with two laterally projecting wings or ribs 18 which engage in the guide grooves 7 of the cap 1*b* and, thus, permit simple assembly of the strain relief 14 on the housing 1. The shape of the cover 14*a* is so matched to the shape of the terminal part 3' that the connecting terminals 4' are completely covered by the cover 14*a* after the strain relief 14 is assembled on the housing 1. This is best seen in FIGS. 6 and 7. The cover 14*a* is formed with an inclined lower edge 20 (FIG. 5), which is fitted to the inclined wall 3*a'* of the terminal part 3' (FIG. 3), which carries the connection terminals 4'. This wall 3*a'* is similar to wall 21, FIG. 1, of terminal part 3. 0f course, if strain relief in the embodiment of FIGS. 1 and 2, in addition to the potting compound is desired, the strain relief 14 can be equally applied to the embodiment shown in FIGS. 1 and 2.

Various changes and modifications may be made, and the invention is not limited to the precise construction of the example described. For example, the parts 3, 3' can be differently coupled to the housing 1 than as described, for example by means of screw connections or by adhesives, plastic welding or the like. The shape of the terminal part 3, 3' can be changed as desired, so long as the shape fits the terminal receiving portion of the housing 1. The terminal part can have as many, or as few, cable connections as required; for example, the terminal part 3' can be formed with two through-openings, one for power supply from an external power source, such as a power network, and one for one, or more, two-wire cables leading to one or more lamps.

Figure 8:
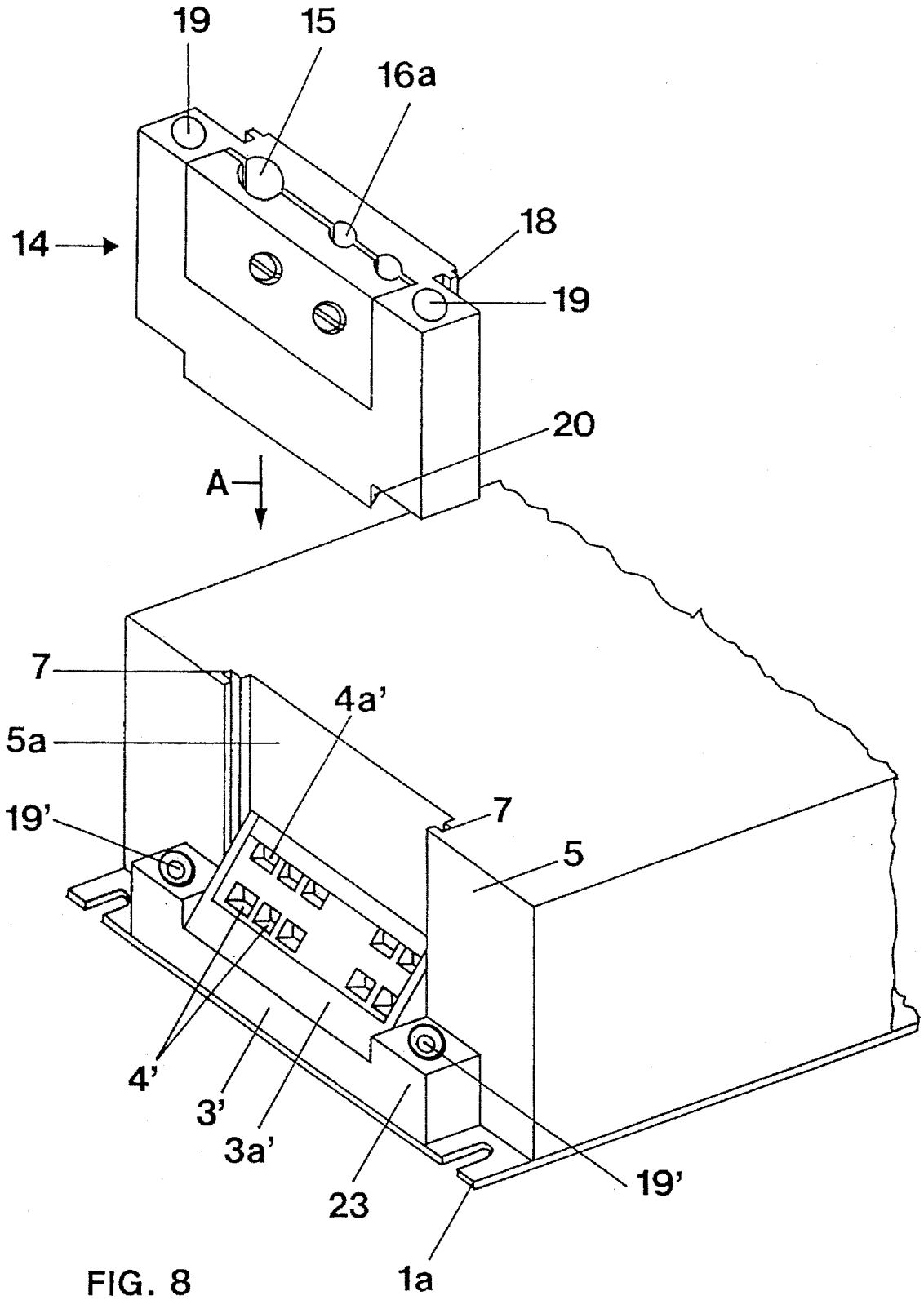
FIG. 8 is a fragmentary exploded view of the embodiment of FIGS. 3 and 4, and illustrating how the various parts fit together.

FIG. 8 is an exploded view illustrating how the parts 14 fit together to the housing 1. The holes 19 in part 14 are matched to holes 19' on side portions 23 (FIGS. 3, 8). Self-tapping screws, not shown, can be used to connect the parts 14 and 1, 3', together. The surface 20 is matched to the surface 3*a'*; the flange 18 (FIG. 8) is matched to the guide groove 7. Arrow A shows how the parts are assembled together.

The cables can be inserted into the terminal openings 4' directly if the ends are strong solid wires or tinned stranded wires The terminals 4', at the inside, for example, have the well-known spring grip connectors, so that a mere push-in of the wire effects a connection. In order to remove a cable, a tool, such as a thin screwdriver, is inserted in the opening 4*a'* through the respective cable hole, to release the grip spring located inside the power supply structure. Conversely, to insert a relatively flexible connector, the spring can be released first, the connector pushed down into the hole 4' and the spring then released, to clamp the cable in the hole 4'.

FIG. 9 is an exploded view showing how the connection part 3' and the housing 1 are assembled.

The printed circuit board 2 and the connection part 3' are secured to the metallic base plate 1*a*, for example by screws, with spacers. The back side of the connection part 3' is seated on the printed circuit board 2 and is connected to the respective circuit paths or tracks of the printed circuit board, as well known, in any suitable manner, for example by contact pins and plugs. This connection also forms the electrical connection between the circuit board and the terminals 4'. Such connections are well known in the art, and form no part of the present invention.

The side walls of the connection part 3' are formed as ribs 6' which, as seen in FIG. 9, upon movement of the cover 1*b* downwardly, see arrow B, will engage in the grooves 7 of the cover 1*b*. The connection part 3' fits into the lower region of the reception depression 5*a* which, towards the back side, is separated from the remainder of the interior of the housing by the wall 10 (FIG. 1) in the housing cap 1*b*. The side walls of the cap 1*b* surround the printed circuit board 2 and the electrical or electronic components located thereon and forming part of the printed circuit.

Of course, the same connection can be made if the connection part is not, as shown, part 3' (FIGS. 3 and 4) but rather the part 3 (FIGS. 1 and 2) which has integral cables extending therefrom. In that case, the electrical connection to the printed circuit board is made by the cables 4 which are soldered to respective circuit paths or tracks on the printed circuit board 2, as well known, and extend outwardly through the respective openings in the connection part 3, as seen in FIGS. 1 and 2.

Other changes and modifications may be made, and any features described herein in connection with any one of the embodiments may be used with any of the others, within the scope of the inventive concept.

We claim:

1. Lamp operating or accessory circuit construction having a housing having a connection portion;

an electrical circuit arrangement retained in the housing; and a modular connection part having selectively differently configured electrical supply means for reception of energy from a source and supply of energy to at least one lamp, said modular connection part comprising an insert element dimensioned and shaped to fit into the connection portion of the housing;

a wire or cable strain relief releasably secured to the housing and positioned for clamping electrical connection means in form of wires or cables extending from the connection part;

wherein the housing is formed with at least one guide groove;

the connection part is formed with at least one projecting element fitting in the guide grooves; and wherein the strain relief is formed with at least one projecting extension or rib fitting in the at least one guide groove.

2. The construction of claim 1, wherein the housing (1) comprises an essentially block or box-shaped cap (1*b*) of plastic material, and a bottom plate closed off by the block or box-shaped cap.

3. The construction of claim 2, wherein the connection portion (5*a*) comprises a recess or opening at an end face (5) of the plastic cap (1*b*).

4. The construction of claim 1, wherein the housing (1) and the connection part (3, 3') are formed with interfitting, matched projection-and-recess guide means (6, 6', 7) to position the connection part (3, 3') on the housing (1).

5. The construction of claim 4, wherein the guide means (6, 6') comprises at least one guide groove (7) formed on the housing and at least one rib or wing or projection extending laterally from the connection part (3, 3') and fitting in said groove.

6. The construction of claim 1, wherein the electrical supply means are configured to comprise cables (4) extending from the connection part (3).

7. The construction of claim 1, wherein the electrical supply means (4') are configured to comprise wire connection means (4') located on the connection part (3') for connection to external wires or cables.

* * * * *